United States Patent [19]

Ikeda

[11] Patent Number: 4,756,564

[45] Date of Patent: Jul. 12, 1988

[54] VEHICLE DOOR LATCH

[75] Inventor: Ichio Ikeda, Aichi, Japan

[73] Assignee: Kabushikikaisha Anseikogyo, Aichi, Japan

[21] Appl. No.: 49,059

[22] Filed: May 12, 1987

[30] Foreign Application Priority Data

Dec. 19, 1986 [JP] Japan ..... 61-303395
Apr. 6, 1987 [JP] Japan ..... 62-84479

[51] Int. Cl.[4] ..... E05C 3/26

[52] U.S. Cl. ..... 292/216; 292/DIG. 38; 292/DIG. 56; 292/DIG. 73

[58] Field of Search ..... 292/DIG. 56, DIG. 73, 292/17, 70, 76, 91, 103, 116, 120, 216, 341.12, DIG. 38

[56] References Cited

U.S. PATENT DOCUMENTS

| | | | |
|---|---|---|---|
| 2,961,267 | 11/1960 | Hungerford | 292/280 |
| 3,091,488 | 5/1963 | Vander Sande et al. | 292/103 X |
| 3,432,198 | 3/1969 | Connor | 292/216 |
| 3,591,216 | 7/1971 | Onufer | 403/146 |
| 3,614,146 | 10/1971 | Marx | 292/216 |
| 3,876,238 | 4/1975 | Watermann | 292/216 |
| 3,905,627 | 9/1975 | Fujita | 292/216 |
| 4,018,104 | 4/1977 | Bland et al. | 403/146 X |
| 4,073,519 | 2/1978 | Kuroyu et al. | 292/DIG. 56 X |
| 4,073,526 | 2/1978 | Sajfert | 292/347 |
| 4,135,694 | 1/1979 | Stegenga et al. | 403/146 X |
| 4,212,560 | 7/1980 | Pufpaff et al. | 403/146 X |
| 4,358,141 | 11/1982 | Hamada | 292/DIG. 56 X |
| 4,382,622 | 5/1983 | Ishikawa | 292/216 |
| 4,478,445 | 10/1984 | Shimizu | 292/336.3 |
| 4,492,395 | 1/1985 | Yamada | 292/216 |
| 4,508,379 | 4/1985 | Mochida | 292/216 X |

*Primary Examiner*—Richard E. Moore
*Attorney, Agent, or Firm*—Pollock, Vande Sande & Priddy

[57] ABSTRACT

A latching member is formed with a recess in which a striker is to be fitted. Each of opposite wall surfaces at the entrance of the recess comprises an elastic member to prevent the occurrence of a large noise upon hit of the striker against those wall surfaces. The recess has its deep part formed to have a width not larger than the diameter of the striker, thereby preventing swing movement of the latching member relative to the striker. Further, a fully locking tooth formed on the latching member has an engagement surface to be engaged with a pawl, the engagement surface being provided with a noiseles member to prevent the occurrence of a large noise upon abutment of the fully locking tooth with the pawl.

4 Claims, 4 Drawing Sheets

VEHICLE DOOR LATCH

BACKGROUND OF THE INVENTION

1. Field of the Invention

This invention relates to a vehicle door latch and more particularly to a vehicle door latch designed to prevent the occurrence of a loud noise during operation.

2. Prior Art

According to the prior vehicle door latch disclosed in U.S. Pat. No. 4,073,519, as shown in FIG. 18, a latching member 52 first approaches a striker 54 when a vehicle door is closed. Subsequently, a wall surface 56 at the entrance of a recess 55 of the latching member abuts with the striker. After abutment, the latching member 52 is turned by the striker in the direction of an arrow 63 from the open position shown in FIG. 18 to the fully locked position shown in FIG. 19. During this turn, the striker 54 progressively goes into the recess 55 formed in the latching member 52 from the entrance to a deep part 59 of the recess 55. The above turning of the latching member 52 into the fully locked position also causes a fully locking tooth 62 to engage with a pawl 53. As a result, the fully locked state as shown in FIG. 19 is achieved.

During such operation of the latch, at the entrance part of the recess 55, a noise suppressor member 57 provided over the wall surface of the recess 55 on the preceding side in the turning direction of the latching member functions to prevent the occurrence of noise upon impact of the latching member 52 with the striker 54. However, when the impact quickly turns the latching member 52 in the direction of an arrow 63, a wall surface 58 at the entrance part of the recess 55 on the succeeding side in the turning direction of the latching member will hit against the striker 54, thereby producing a noise upon impact.

On the other hand, a width 60 of the recess 55 at the deep part 59 is generally designed larger than a design diameter of the striker 54. This results from the reason that, if the width 60 is designed equal to a typical diameter of the striker 54, in case of the striker 54 having an unexpectedly larger diameter due to the size tolerance, the striker 54 would be caught by the wall surface of the deep part 59 and become difficult to slip out therefrom when releasing the striker 54 which has been forced into the deep part 59. Of course, if the width 60 is set smaller than the diameter of the striker 54, the same phenomenon would occur. With the width 60 being larger than the diameter of the striker 54 as mentioned above, when the striker 54 goes into the deep part 59 of the recess during the closing process of the door, a play exists between the wall surface of the deep part 59 and the striker 54. Therefore, the latching member 52 becomes swingable relative to the striker 54. Upon swinging of the latching member 52, a wall surface 61 of the deep part 59 on the succeeding side will hit against the striker 54, thereby producing noise.

The aforementioned impact noise caused by quick turn of the latching member can be prevented by attaching a noise suppressor member over the wall surface 58 at the entrance of the recess 55 on the succeeding side. However, the wall surface 61 of the deep part 59 on the succeeding side serves as a surface with which is engaged the striker 54 in the fully locked position. For this reason, a noise suppressing member cannot be attached thereto. Thus, the presence of the above play inevitably causes objectionable noise.

SUMMARY OF THE INVENTION

It is therefore a primary object of the present invention to provide a vehicle door latch of the type that, when a vehicle door is closed, a wall at the entrance of a recess of a latching member abuts with a striker, the latching member is then turned by the striker from the open position to the fully locked position with the striker going into the recess of the latching member during this turn, and a fully locking tooth of the latching member is engaged with a pawl in the fully locked position so that the fully locked state is achieved.

Another object of the present invention is to provide a vehicle door latch with which locks quietly without producing a large noise.

Still another object of the present invention is to provide a vehicle door latch which can prevent the occurrence of noise upon impact of the wall at the entrance of a recess of the latching member with the striker.

Still another object of the present invention is to provide a vehicle door latch that, even when the impact caused by abutment of the wall at the entrance of recess of the latching member with the striker quickly turns the latching member, and then a wall surface at the entrance part of the recess on the succeeding side in the turning direction of the latching member hits against the striker, the occurence of noise upon such impact can be prevented.

Still another object of the present invention is to provide a vehicle door latch which ensures quiet operation by eliminating any causes which may possibly produce a noise during the process of the striker going into a deep part of the recess.

More specifically, in the present invention, the deep part of the recess has a width not larger than the diameter of the striker. Accordingly, there is no play between the opposite wall surface of the recess at the deep part and the striker. This renders the latching member not swingable relative to the striker. Thus, the cause of noise is absent. As a result, the striker can quietly penetrate into the deep part of the recess.

Still another object of the present invention is provide a vehicle door latch which can smoothly release the striker which has been forced into the deep part, even with the above design where the width of the recess at the deep part is selected not larger than the diameter of the striker.

In the present invention, the wall surface of the recess at the deep part on the preceding side is formed of an elastic member which has a flexibly deformable form. Therefore, when withdrawing the striker out of the deep part, that wall surface is flexibly deformed in accordance with movement of the striker. As a result, the striker can be withdrawn smoothly at any time.

A further object of the present invention is to provide a vehicle door latch in which there is no play between the striker and the opposite wall surfaces of the recess at the deep part, as mentioned above, and the wall surface of the deep part on the succeeding side is designed such that, even when that wall surface is formed of an elastic member in a region from the entrance to the intermediate part and a hard material in a deeper region, the striker will not encounter any obstruction step at the boundary between those two regions when it passes therethrough, permitting the striker to smoothly advance toward the deep part.

A still further object of the present invention is to provide a vehicle door latch which permits the pawl to be engaged with the fully locking tooth on the latching member in a quiet manner.

More specifically, when the vehicle door is closed, the latching member is usually turned from the open position to a point slightly beyond the fully locked position due to the inertia of the door. The latching member is then turned back toward the open position. During this backward turn, the fully locking tooth of the latching member abuts at its engagement surface with the latching surface of the pawl at the fully locked position. At this time, according to the present invention, a noiseless member provided on the engagement surface of the tooth comes into abutment with the latching surface of the pawl. Therefore, the intended latching is quietly effected without producing a loud impact noise.

A still further object of the present invention is to provide a vehicle door latch that even with the above engagement surface having the noiseless member provided thereon for the quiet operation, when the large pressure exerted on the vehicle door in the opening direction applies a large force to the latching member toward the open position, the noiseless member is pushed and compressed. This causes a hard engagement surface of the fully locking tooth to directly abut with the latching surface of the pawl, whereby the latching member can rigidly be held in the latched state thereof at the fully locked position.

A still further object of the present invention is to provide a vehicle door latch which can prevent breakage of the noiseless member and offer the effect of preventing the occurrence of such an impact noise for a long service life.

More specifically, in the present invention, the noiseless member is provided in a recess formed in the engagement surface of the fully locking tooth. Accordingly, even when the noiseless member is pushed and compressed as mentioned above, the above recess of the engagement surface can accommodate the intrinsic volume of the noiseless member. As a result, the noiseless member can be prevented from collapsing flat or tearing off. Thus, after the noiseless member is released from the pushed and compressed state, it restores to the original configuration so that the effect of preventing the occurrence of an impact noise may be offered for a long service life. Other objects and advantages of the invention will become apparent during the following description of the accompanying drawings.

DETAILED DESCRIPTION OF THE EMBODIMENTS

Figure 1:
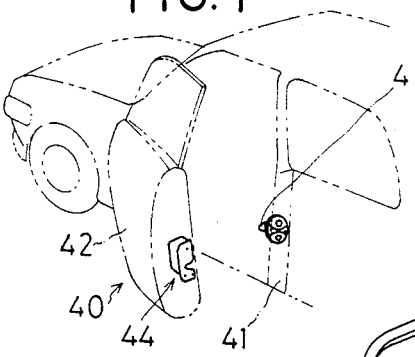
FIG. 1 is a perspective view showing the mounted state of a vehicle door locking device on an automobile.
Figure 3:
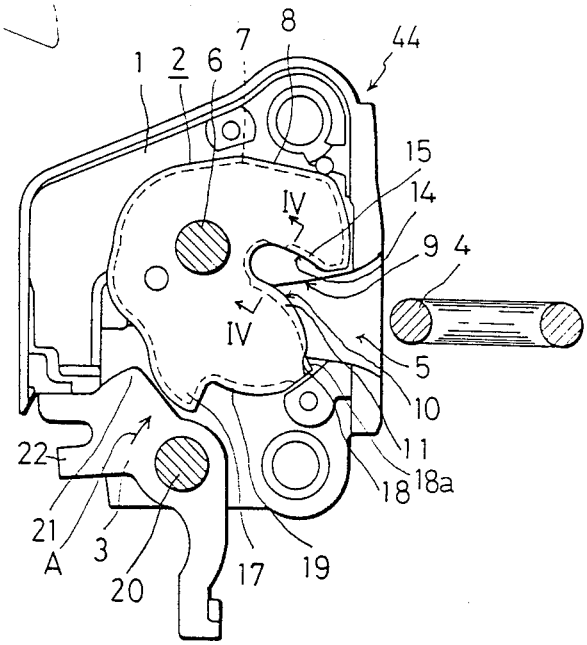
FIG. 3 is a vertical sectional view of a door latch.
Figure 2:
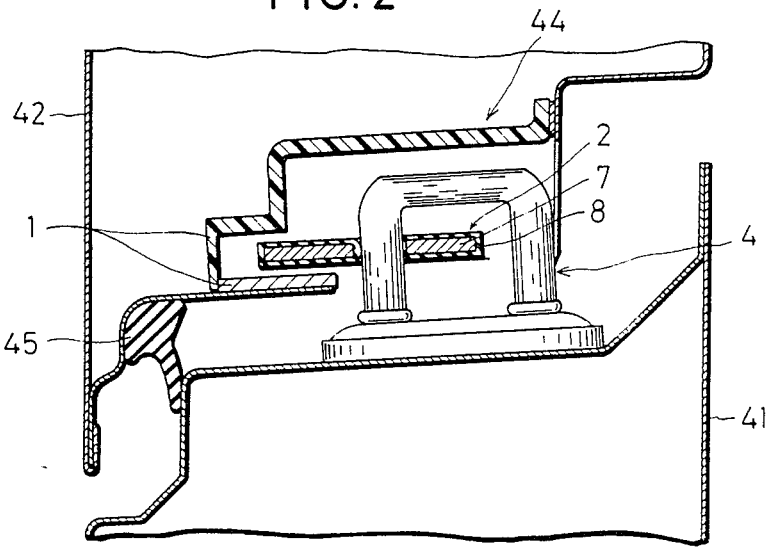
FIG. 2 is a horizontal sectional view of the vehicle door locking device when a door of the automobile is in the closed state.

Referring to FIGS. 1 and 2, a vehicle door locking device comprises a striker 4 mounted to a body 41 of an automobile 40, and a door latch 44 mounted to a door 42. As best shown in FIGS. 2 and 3, the door latch 44 includes a base frame 1, and a latching member 2 and a pawl 3 both of which are pivoted to the base frame 1. The base frame 1 may be formed in a well known manner by pressing a metal plate such as an iron plate, or by molding a synthetic resin material. Designated at reference numeral 5 is a groove for introducing the striker.

Figure 4:
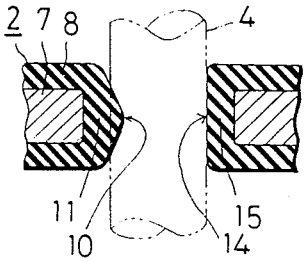
FIG. 4 is a sectional view taken along the line IV—IV in FIG. 3.
Figure 12:
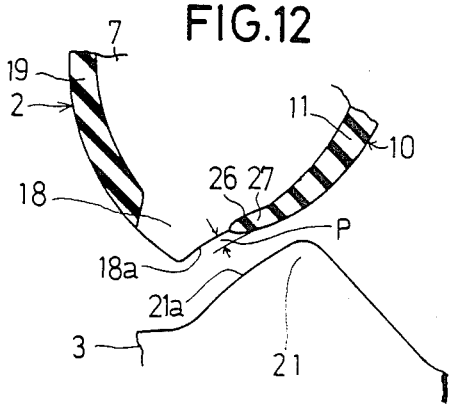
FIG. 12 is an enlarged view of the part XII in FIG. 9.
Figure 17:
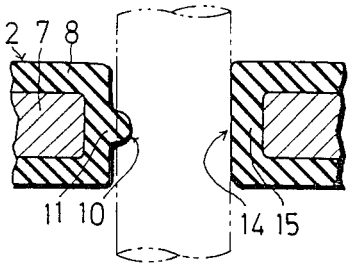
FIG. 17 is a sectional view showing a modified example of the configuration of an elastic member at the recess the latching member.
Figure 18:
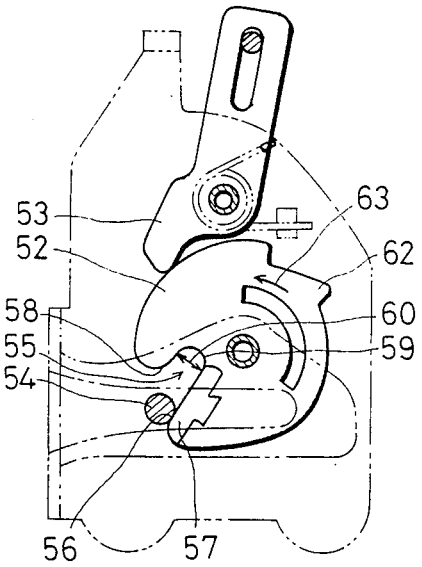
FIG. 18 PRIOR ART
FIGS. 18 and 19 are views showing a prior vehicle door latch.
Figure 19:
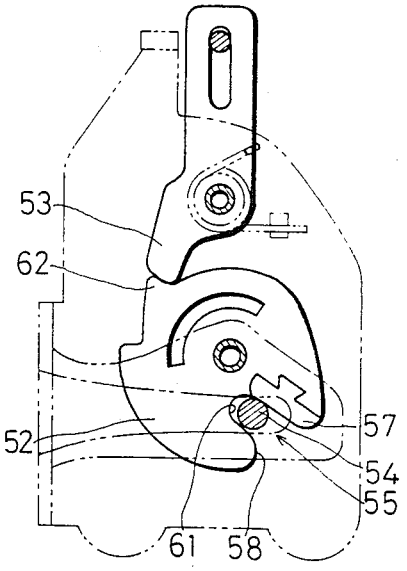
FIG. 19 PRIOR ART

The latching member 2 is rotatably supported to the base frame 1 by means of a shaft 6. The latching member 2 is composed of a base body 7 formed of a hard material, e.g., a metal material such as iron, and a coating 8 coated over the circumference of the base body except for the part thereof. The base body 7 may be formed of any other suitable hard materials such as ceramics. The coating 8 is made of rubber or elastomer and coated over the base body 7 into a completely integral piece. The latching member 2 has recess 9 in which the striker is received, a half-locking tooth 17, and a fully locking tooth 18. As clearly shown in FIG. 11, the fitting recess 9 is so formed that the width W between opposite wall surfaces 10 and 14 at the entrance is larger than the diameter D of the striker 4, with the width being progressively narrowed toward a deep part of the recess, and the width W' between the opposite wall surfaces 10 and 14 at the point where the striker is located in the fully locked state (i.e., the deepest part of the recess) is slightly (e.g., about 0.2 mm) narrower than the diameter D of the striker. It is to be noted that, in this specification, a region of the recess 9 where the width between the opposite wall surfaces 10 and 14 is larger than the diameter of the striker 4 is referred to as an introduction part **9*a*, a region of the recess 9 with which the striker 4 contacts in the fully locked state is referred to as a fitting part 9*c*, and a region of the recess 9 between those two regions is referred to as a guide part 9*b*. It is thus needless to say that the width at the guide part 9*b* is equal to or smaller than the diameter of the striker 4. As to the inner surface of the recess 9, the wall surface 10 serves as a wall surface on the preceding side in the direction in which the latching member 2 is pushed and turned by the striker 4 from the open position shown in FIG. 3 to the fully locked position shown in FIG. 10, the wall surface being an elastic member 11. The elastic member 11 is formed by a part of the coating 8. The elastic member 11 constitutes the wall surface 10 thoroughly ranging from an initial abutment part 12 with the striker 4 (see FIG. 5) to an abutment part 23 with the striker 4 in the fully locked position (see FIGS. 10 and 11). Thus, all regions of the wall surface 10 throughout the introduction part 9a, the guide part 9b and the fitting part 9c are given by the elastic member 11. The wall surface 14 serves as a wall surface on the succeeding side in the direction in which the latching member is pushed and turned. The wall surface 14 is given by an elastic member 15 only at the entrance part of the recess 9. The elastic member 15 is also formed by a part of the coating 8. The elastic member 15 constitutes the wall surface 14 ranging from the part facing the initial abutment part 12 of the opposite wall surface 10, beyond a part 24 (see FIG. 11) where the width W" of the recess 9 equals the diameter D of the striker 4, to a point short of an abutment part 16 with the striker 4 in the fully locked position (see FIGS. 10 and 11). Thus, the wall surface 14 of the recess 9 on the succeeding side extending through the introduction part 9a and a portion of the guide part 9b nearer to the introduction part 9a is given by the elastic member 15. The remaining region of the wall surface 14 from the end of the elastic member 15 to the full-lock fitting part 9c, or to the abutment part 16 with the striker 4 in the fully locked position, is formed of a hard material. In other words, the metal surface of the base body 7 is exposed. The elastic members 11 and 15 are formed to have their respective sectional configurations as shown in FIG. 4, so that the elastic member 11 has a smaller contact area with the striker 4 than the elastic member 15 and hence the former is more liable to deform elastically. Alternatively, the elastic member 11 may have the sectional configuration as shown in FIG. 17. As another alternative, the elastic member 11 may be formed to have the same configuration as the elastic member 15, but using a softer material. As clearly shown in FIG. 12, the fully locking tooth 18 has an engagement surface 18a in which the base body 7 is exposed. The engagement surface 18a has a recess 26 formed therein at a point nearer to the center of the latching member 2. In the recess 26, there is provided a noiseless member 27 constituted by a part of the coating 8. The noiseless member 27 has the surface slightly projecting out of the engagement surface 18a**. The size P of such projection is about 0.1 to 0.2 mm by way of example.

The pawl 3, formed of a metal material, is pivoted to the base frame 1 by means of a shaft 20 and urged in the direction of an arrow A in FIG. 3 by means of a well known spring (not shown). As known in the art, the pawl 3 has a pawling tooth 21, an operated portion 22, etc.

Figure 5:
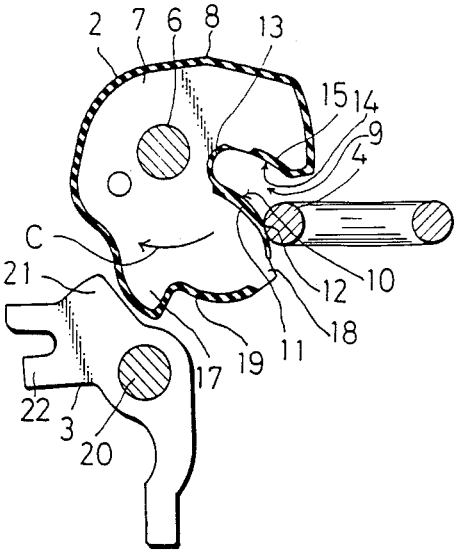
FIGS. 5 to 10 are views for explaining the operation.
Figure 6:
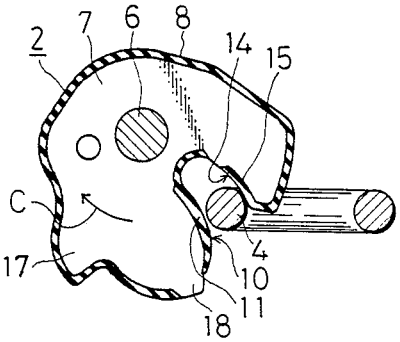
Figure 7:
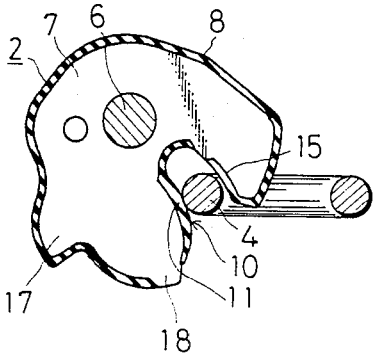

Operation of the abovementioned arrangement will now be described. When the door 42 is moved toward the body 41 from the state of FIG. 1, the door latch 44 approaches the striker 4 as shown in FIG. 3. Soon after, as shown in FIG. 5, the latching member 2 in the open position abuts at the initial abutment part 12 in the wall surface 10 of the recess 9 with the striker 4. The striker 4 then pushes and turns the latching member 2 in the direction of an arrow C in FIG. 5. As the latching member 2 is turned, the striker 4 progressively goes into the recess 9. During the above step, since the initial abutment part 12 is formed of the elastic member 11, there produces no loud noise upon the initial abutment part 12 abutting with the striker 4. If the impact at such abutment is large, the latching member 2 bounced in the direction of an arrow C and, as shown in FIG. 6, the wall surface 14 abuts with the striker 4. But, since the wall surface 14 is formed of the elastic member 15, there produces no large impact noise. Further continued movement of the door latch with the door still swung in the closing direction causes the wall surface 10 to be again abutted with the striker 4, as shown in FIG. 7. But, since that abutment portion is also formed of the elastic member 11, there produces no large noise too.

Figure 8:
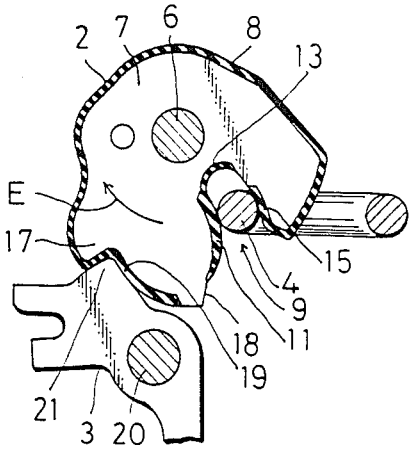
Figure 9:
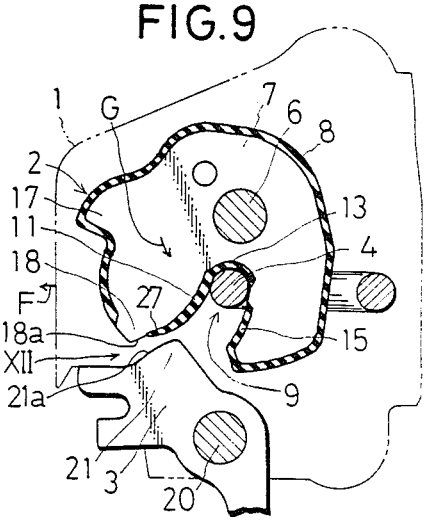
Figure 10:
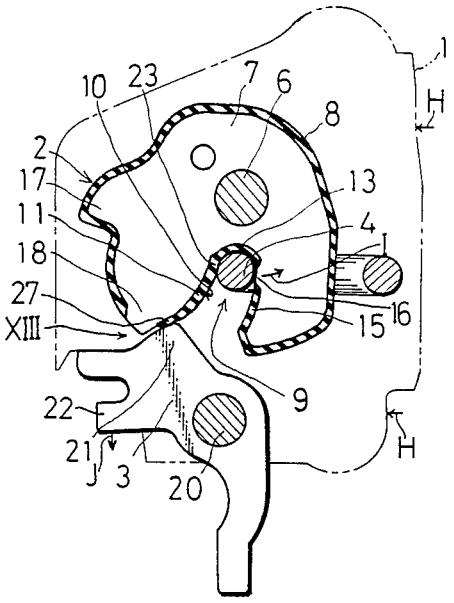
Figure 13:
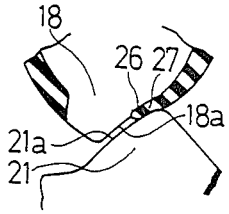
FIG. 13 is an enlarged view of the part XIII in FIG. 10.

Following the abovementioned process, the latching member 2 is continuedly turned and soon after, as shown in FIG. 8, the pawling tooth 21 rides over the halflocking tooth 17 of the latching member. At this time, an elastic member 19 prevents the occurrence of an impact noise upon hit of the pawling tooth 21 against the half-locking tooth 17. As the door latch continues to move with the door still swung in the closing direction, the latching member 2 is further turned in the direction of an arrow E in FIG. 8. As a result, the striker 4 goes into a deep part of the recess. Soon after, as shown in FIG. 2, a weather strip 45 attached to the door 42 is compressed and the door 42 is stopped in its movement. At this time, as shown in FIG. 9, the latching member 2 has been turned to a location slightly beyond the fully locked position. Also, the pawl 3 has been turned to a location where a pawling surface 21a on the pawling tooth 21 is opposite to the engagement surface 18a of the fully locking tooth 18. After this overrun state, the door 42 is pushed back outwardly by a resilient force of the weather strip 45. As a consequence, the door latch 44 is moved relative to the striker 4 in the direction of an arrow F in FIG. 9. This movement causes the latching member 2 to turn in the direction of an arrow G in FIG. 9. Accordingly, as shown in FIGS. 10 and 13, the noiseless member 27 on the fully locking tooth 18 is abutted with the pawling surface 21a of the pawl 3 so that the latching member 2 is stopped at that location, i.e., at the fully locked position. On this occasion, since the noiseless member 27 abuts with the pawling surface 21a as mentioned above, there produces no loud noise upon such abutment.

Out of the foregoing operation process, the step from abutment of the intitial abutment part 12 with the striker 4 to fitting of the striker 4 into the deep part of the recess 9 will now be described in more detail with reference to FIG. 11. When the initial abutment part 12 abuts with the striker 4 as shown at (a) in FIG. 11, there produces no large noise owing to the initial abutment part 12 formed of the elastic member 11. The striker 4 then goes into the introduction part 9a of the recess 9. During this step, even if the latching member 2 is swung relative to the striker 4, the occurrence of a loud noise is prevented because the opposite wall surface 10, 14 at the introduction part 9a are both formed of the elastic members 11, 15, respectively.

Figure 11:
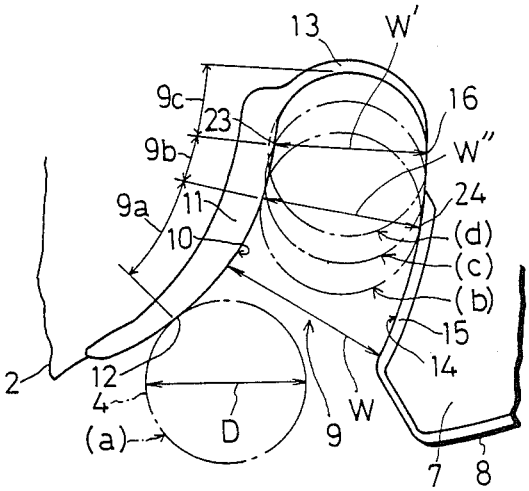
FIG. 11 is an enlarged partial view showing the positional relationship between a recess and a striker.

Next, as shown at (b) in FIG. 11, the striker 4 goes into the entrance of the guide part 9b, i.e., the point where the width W" between the opposite wall surfaces 10 and 14 is equal to the diameter D of the striker 4. At this time, the striker 4 comes into such a state that it contacts both the wall surface 10 on the preceding side and the wall surface 14 on the succeeding side. Upon such contact, no loud noise is produced because the wall surfaces 10, 14 are formed of the elastic members 11, 15, respectively.

After that, the striker 4 goes through the guide part 9b toward the fitting part 9c. During this advancement, no play is present between the opposite wall surfaces 10, 14 and the striker 4. Accordingly, the latching member 2 is not swung relative to the striker 4, so there is no noise. During the step where the striker 4 advances through the guide part 9b, as shown at (c) in FIG. 11, the striker 4 passes the boundary in the wall surface 14 on the succeeding side between the region where the elastic member 15 is provided and the region where the metal surface is exposed. Upon this passage, the striker 4 can smoothly pass the boundary because no appreciable step is caused at the boundary between those two regions for the reason as follows. Specifically, when the width between the opposite wall surfaces 10 and 14 is equal to the diameter of the striker 4 in the vicinity of the boundary, there causes of course no step. On the other hand, when the width between the opposite wall surfaces 10 and 14 is smaller than the diameter of the striker 4 at a position short of the boundary (nearer to the introduction part 9*a*), the striker 4 advances while compressing the wall surface 10 to deform, because the wall surface 10 is formed to be more easily deformable than the wall surface 14 as mentioned above. Thus, no step is caused on the wall surface 14.

After going through the guide part 9*b*, the striker 4 reaches the fitting part 9*c* as shown at (d) in FIG. 11. Namely, it reaches the position corresponding to the fully locked state. At this time, the striker 4 is received by the elastic member 13 provided at the bottom of the recess 9 and, therefore, no impact noise is produced upon such impact of the striker against the recess bottom. In this way, the striker 4 can advance to the position of the fully locked state without producing any large noise upon impact with the latching member 2.

In the state that the latching member 2 is fully locked, the striker 4 is abuts with the abutment part 16 where the metal surface is exposed. Therefore, the engagement between the latching member 2 and the striker 4 is positive.

Figure 15:
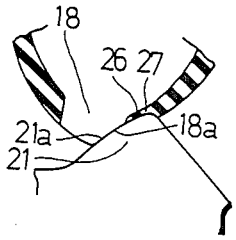
FIG. 15 is an enlarged view of the part XV in FIG. 14.
Figure 14:
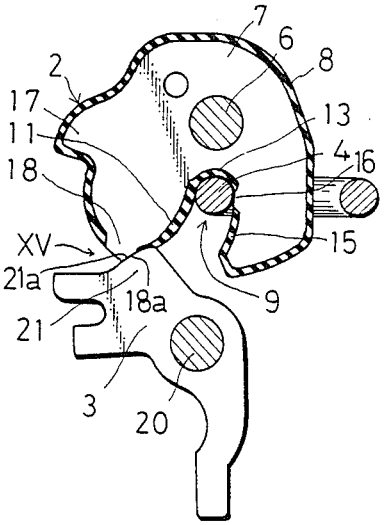
FIG. 14 is a view showing the relationship between a latching member and a pawl when a door opening force is applied to the door in the closed state.

If a passenger on the automobile leans against the door with large pressure in the fully locked state, the door latch 44 undergoes a large force applied in the direction of an arrow H in FIG. 10. Upon application of such a force, the latching member 2 is relatively drawn by the striker 4 in the direction of an arrow I so as to turn in the sane direction of an arrow I. This causes, as shown in FIGS. 14 and 15, the noiseless member 27 on the engagement surface 18*a* to be pushed and compressed into the recess 26 so that the engagement surface 18*a* directly abuts with the pawling surface 21*a* of the pawl 3. As a result, the latching member 2 stops its turning in the direction of an arrow I and the fully locked state is maintained positively. Incidentally, if the force applied to the door is released, the noiseless member 27 compressed into the recess 26 restores to the state as shown in FIGS. 10 and 13 by virtue of its own elasticity.

Figure 16:
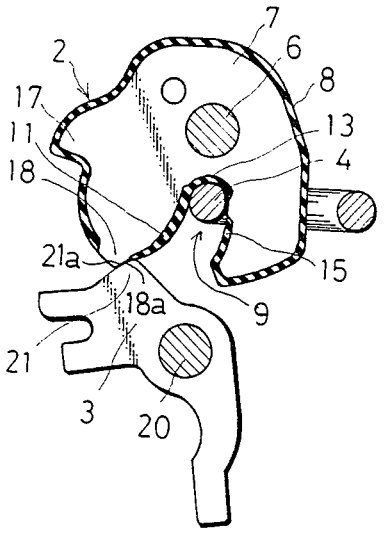
FIG. 16 is a view showing the relationship between the latching member and the pawl in the fully locked state when the door has been closed slowly.

In case of closing the door of the automobile, when the door 42 is pushed by a hand to be slowly closed, the door 42 has no inertia in its closing operation. Accordingly, the latching member 2 will not turn beyond the fully locked position as is shown in FIG. 9. Instead, when the latching member 2 reaches the fully locked position, the pawl 3 will get into engagement with the fully locking tooth 18 with the pawling surface 21*a* of the pawl 3 sliding into along the engagement surface 18*a* of the tooth 18, as shown in FIG. 16. In this connection, the noiseless member 27 is provided at a point a short distance inwadly from the distal end of the tooth 18. This permits the pawl 3 to slip into the state where a part of the pawling surface 21*a* is opposite to the engagement surface 18*a*. In this case, therefore, the positive fully locked state is also achieved.

When releasing the engagement between the striker 4 and the latching member 2, the operated portion 22 of the pawl 3 is moved in the direction of an arrow J in FIG. 10 as well known in the art. This disengages the pawling tooth 21 from the fully locking tooth 18, so that the latching member 2 is turned counterclockwise to the open position of FIG. 3. During this turn, the striker 4 is withdrawn from the recess 9. At this time, since the wall surface 10 is formed to be very flexible, it is possible for the striker 4 to smoothly withdraw from the recess 9.

The elastic members 11, 15, 13, 19 and the noiseless member 27 may be formed independently of one another and attached to the respective predetermined locations on the base body 7.

As to the latching member 2, the width of the recess 9 at the region deeper than the point, where the state (b) of FIG. 11 is effected, may by set equal to the diameter D of the striker 4.

As many apparently widely different embodiments of this invention may be made without departing from the spirit and scope thereof, it is to be understood that the invention is not limited to the specific embodiments thereof except as defined in the appended claims.

What is claimed is:

1. A vehicle door latch comprising:

(a) a striker mounted to a stationary part of said vehicle;

(b) a base frame mounted to a door of said vehicle, supporting for rotation a latching member, said latching member including an elongated recess open to receive said striker, which rotates from a striker receiving position to a closed striker retaining position holding said door fast with said striker; said recess formed from first and second facing walls which extend from an open enctrance to a remote closed deep part, said recess having a width at said open entrance larger than said striker width, and a width at said deep part which is not larger than said striker width, said recess width decreasing from said entrance to said deep part and having an intermediate portion of the same width as said striker width;

(c) said first wall lying in the direction of rotation of said latching member during rotation from said receiving position to said retaining position, having a surface formed from a first elastic member extending from said open entrance to said deep part; and, (d) said second wall having a surface formed from a second elastic member extending from said entrance opening beyond a portion of said recess where the width is equal to said striker width, said second elastic member being formed of a material which is less easily deformable than said first elastic member.

2. A vehicle door latch according to claim 1, wherein the first wall surface of said recess is formed to have a smaller abutment area with said striker than the second wall surface of said recess so that the first wall surface of said recess is more easily flexible than the second wall surface of said recess.

3. A vehicle door latch including:

(a) a base frame mounted to a door of an automobile;

(b) a latching member supported for rotation on said base frame, said latching member including a striker receiving recess open to receive a striker on a stationary part of said automobile, and rotating on impact of said striker to a fully locked position locking said door to said automobile, said recess defined by first and second radially extending facing walls, said latching member including a peripheral extending locking tooth having an engagement surface which engages a pawl when said latching member is in the fully locked position, said engagement surface having a recess supporting an elastic material;

(c) a first deformable elastic member extending along the first wall of said striker receiving recess which leads in the direction of rotation of said latching member during locking of said door, said elastic member extending from an entrance defined by said walls to a deep part;

(d) a second elastic member less easily deformable than said first elastic material, having a first portion extending over the second wall of said recess from said open entrance beyond a portion of said recess having a width greater than said striker width and a second portion of a harder material than said first portion extending from said first portion to said deep part, said first and second elastic members defining a recess width which at an entrance thereof is greater than said striker width, said recess having an intermediate portion width equal to said striker width, and a deep part having a width not greater than said striker width; and, (e) a pawl member supported on said base frame having a pawling surface for engaging said locking tooth elastic material when said latching member rotates to the fully locked position and holding said latching member in said fully locked position, said elastic material reducing noise produced form impact of said pawl member and locking tooth.

4. The vehicle door latch of claim 1 wherein said first elastic member has a smaller striker contacting surface area than said second elastic member.

* * * * *